US005193749A

United States Patent [19]

Sakagami et al.

[11] Patent Number: 5,193,749

[45] Date of Patent: * Mar. 16, 1993

[54] FUEL INJECTION VALVE

[75] Inventors: Eiji Sakagami, Anjo; Yoshiyuki Okamoto, Kariya, both of Japan

[73] Assignee: Aisin Seiki Kabushiki Kaisha, Kariya, Japan

[ * ] Notice: The portion of the term of this patent subsequent to Apr. 14, 2009 has been disclaimed.

[21] Appl. No.: 737,647

[22] Filed: Jul. 30, 1991

[30] Foreign Application Priority Data

Jul. 31, 1990 [JP] Japan ..... 2-203390

[51] Int. Cl.[5] ..... B05B 1/30

[52] U.S. Cl. ..... 239/585.1; 137/898

[58] Field of Search ..... 239/585.1, 407–409, 239/411; 137/898, 596.17; 123/531, 533, 90.11

[56] References Cited

U.S. PATENT DOCUMENTS 4,020,803 5/1977 Thuren et al. ..... 123/90.11
4,655,255 4/1987 Rode ..... 137/596.17
5,104,046 4/1992 Sakagami ..... 239/409

FOREIGN PATENT DOCUMENTS 62-93481 4/1987 Japan .

*Primary Examiner*—Andres Kashnikow
*Assistant Examiner*—Lesley D. Morris
*Attorney, Agent, or Firm*—Oblon, Spivak, McClelland, Maier & Neustadt

[57] ABSTRACT

A fuel injection valve has only one set of coil and armature to control both of the amount of fuel and the injection of fuel from the injection nozzle.

3 Claims, 2 Drawing Sheets

FUEL INJECTION VALVE

BACKGROUND OF THE INVENTION

1. Field of the Invention

This invention relates to a fuel injection valve, and especially to a fuel injection valve for an internal combustion engine of an automobile.

2. Description of Prior Art

A 2 cycle engine has been developed to provide a small, high power, low fuel consumption, low vibration engine. A fuel injection valve for 2 cycle engine, however, has not fully satisfied with the requirements. More often, a fuel injection valve for 4 cycle engine is modified for 2 cycle engine.

FIG. 3 is a sectional view of a conventional fuel injection valve shown in Japanese Patent Laid-Open 62 (1987)-93481. Referring to FIG. 3, fuel is provided from a fuel tank 35 to an injector 30 through a pump 36. A pressured air provided by an air source 37 is applied to a chamber 32. A figured amount of fuel is applied to a chamber 32 by the injector 30. A solenoid 31 operates a valve 33 to inject fuel with the pressured air through an injection port 34.

The above mentioned conventional fuel injection valve has two solenoids. One solenoid (not shown in FIG. 3) controls the injector 30 to supply a certain amount of fuel into the pressured chamber 32 and the other solenoid 31 controls the injection of fuel through the injection port 34. Therefore, the size of the fuel injection valve becomes big. Also it is fairly complex to control two solenoid valves with the engine operation.

An object of the present invention is to provide a fuel injection valve having improved the above-mentioned drawbacks, especially a fuel injection valve which has one solenoid.

Other objects will be apparent from an understanding the invention.

In accordance with this invention, a fuel injection valve comprises an armature made of magnetic material and having a hole, a coil placed around the armature, a fuel supply port connected to the hole of the armature, the first rod placed in said hole of the armature, a core made of magnetic material and having a hole, a control valve connected to the first rod and placed in the hole of the core, a nozzle connected to the core having an injection port, a second rod placed in the nozzle and having a fuel passage which is opened and closed by the control valve, a diaphragm attached to the second rod and dividing a room between the core and the nozzle into a fuel chamber and a mixture chamber, a first spring between the nozzle and the diaphragm to push the diaphragm toward the control valve, the second spring between the first rod and the armature to push the first rod toward the control valve, a mixture passage in the nozzle connecting the mixture chamber and the fuel passage, and a one way valve placed at the injection port of the nozzle, wherein, when the control valve closes the fuel passage of the second rod, a gap is made between the control valve and the armature to establish a passage to supply fuel into the fuel chamber from the fuel supply port.

In accordance with this invention, when a lower current power is supplied to the coil, the control valve is moved toward the armature against the second spring to open the fuel passage in the second rod. The fuel in the fuel chamber is supplied to the mixture passage and the mixture chamber through the fuel passage.

When a higher current power is supplied to the coil, the armature moves toward the core and pushes the control valve through the first rod against the first spring. The second rod is moved to open the one way valve to inject the mixture of fuel through the injection port of the nozzle.

Thus the fuel injection valve of this invention comprises one solenoid. This makes the fuel injection valve smaller. In addition to this, the diaphragm isolates the fuel chamber and the mixture chamber to prevent the mixture fuel from going back to the fuel chamber. This makes the control of fuel amount easier.

BRIEF DESCRIPTION OF THE DRAWINGS

The objects and advantages of the invention will become apparent from the following detailed description of preferred embodiment thereof in connection with the accompanying drawing in which.

DETAILED DESCRIPTION OF A PREFERRED EMBODIMENT OF THE INVENTION

Figure 1:
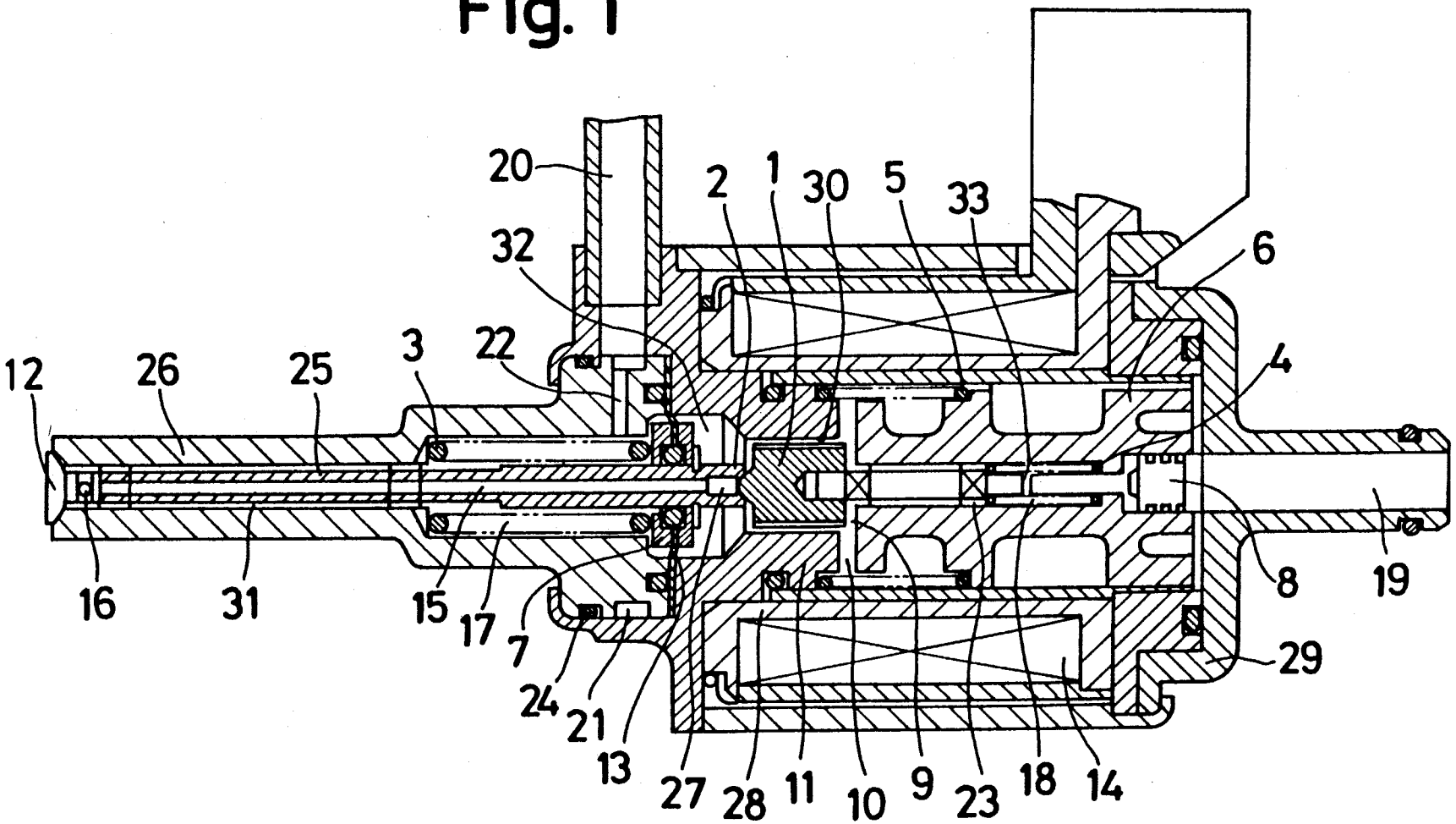
FIG. 1 is a sectional view of a preferred embodiment of fuel injection valve in accordance with the present invention.

A preferred embodiment of the fuel injection valve is shown in FIG. 1. Referring to FIG. 1, a control valve 1 made of magnetic material is connected to a rod 33. A movable valve seat 2 is placed in the same axial side of the control valve 1 so that the control valve 1 can close and open the movable seat 2. The movable seat 2 has a fuel passage 27. A second spring 4 pushes the portion 23 to put the control valve 1 in the closed position so that the fuel passage 27 of the rod 33 is closed. The second spring 4 is placed in a fuel chamber 18 provided in an armature 6 and the spring 4 pushes the control valve 1 to keep a gap 9 between the control valve 1 and the armature 6. The armature 6 is inserted into a bobbin 28 made of non-magnetic material. The bobbin 28 has a coil 14. Then a core 11 is inserted into the bobbin 28. A third spring 5 is placed between the core 11 and the armature 6 to keep a gap 10 between the core 11 and the armature 6. The other side of the armature 6 contacts with a cover 29 which has a fuel supply port 19. The core 11 has a hole 30 which receives the control valve 1, a fuel chamber 32 which connects with the hole 30 and a mixture chamber 17. The fuel chamber 32 and the mixture chamber 17 are isolated by a diaphragm 13. A base of a fuel injection nozzle 26 is inserted into the core 11. The fuel injection nozzle 26 has a mixture passage 31 which connects to the mixture chamber 17. One way valve 12 is attached to the end of the nozzle 26 and a rod 25 which has a fuel passage 15 is inserted into the nozzle 26. The end of the rod 25 is connected to the movable seat 2. The one way valve 12 is closed by the first spring 3.

The first spring 3 is placed between the nozzle 26 and a stopper 7. The spring force of the first spring 1 is to be set bigger than that of the second spring 4. The second spring 4 and the third spring 5 work the opposite direction, the gap 9 is made between the control valve 1 and the armature 6. The outer portion of the diaphragm 13 is fixed between the core 11 and the nozzle 26 and the inner portion of the diaphragm 13 is connected to the stopper 7 which is connected to the rod 25 through a rubber ring. Thus the mixture chamber 17 is isolated from the fuel chamber 32 by the diaphragm 13. A fuel injection port 16 is connected to a mixture passage 31. An air supply port 20 is connected to the mixture chamber 17 and the mixture passage 31 via recess 21 and passage 22 in the nozzle 26. A seal ring 24 is provided between the nozzle 26 and the core 11. The spring force of the third spring 5 is to be set bigger than that of the second spring 4.

The pressured air is always supplied to the mixture chamber 17 and the mixture passage 31 through the air supply port 20. The power is supplied to the coil 14 in two stages. First stage is to supply the calculated amount of the fuel. In this stage the lower electric power in accordance with the engine requirements is supplied to the coil 14. The spring force of the third spring 5 is bigger than that of the second spring 4, therefore the armature 6 stays in the same position and the control valve 1 is moved toward the armature against the spring force of the second spring 4. The control valve 1 opens the movable seat 2 so that the fuel in the fuel chamber 32 is supplied to the mixture passage 31 through the fuel passage 15 and the fuel injection port 16 but the one way valve 12 remains closed. The fuel is supplied from the fuel supply port 19 to the fuel chamber 32 through the outer surface of the stopper 8, the hole 30 of the core 11 and the outer surface of the control valve 1.

The second stage is to inject the fuel in the mixture chamber 17. In this stage a higher current power is supplied to the coil 14. The armature 6 is moved toward the core 11 against the spring force of the third spring 5. The armature 6 pushes the movable seat 2 against the spring force of the first spring 3 through the control valve 1. Thus the rod 25 is pushed to open the one way valve 12 while the control valve is closed. The mixture of the fuel and the pressured air in the mixture passage 31 is injected from the nozzle 26. Thus the control valve and the one way valve are in series with respect to fuel flow.

Figure 2:
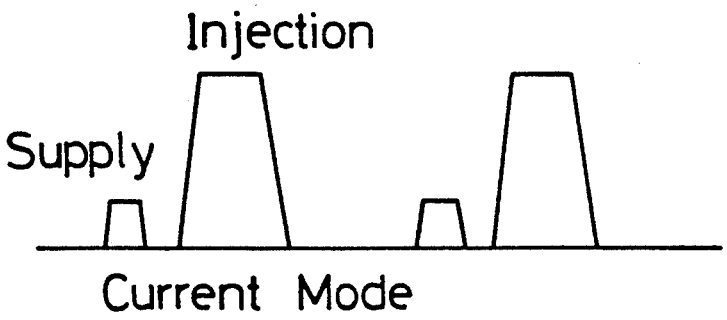
FIG. 2 is a graph showing a current which is applied to the fuel injection valve shown in FIG. 1.
Figure 3:
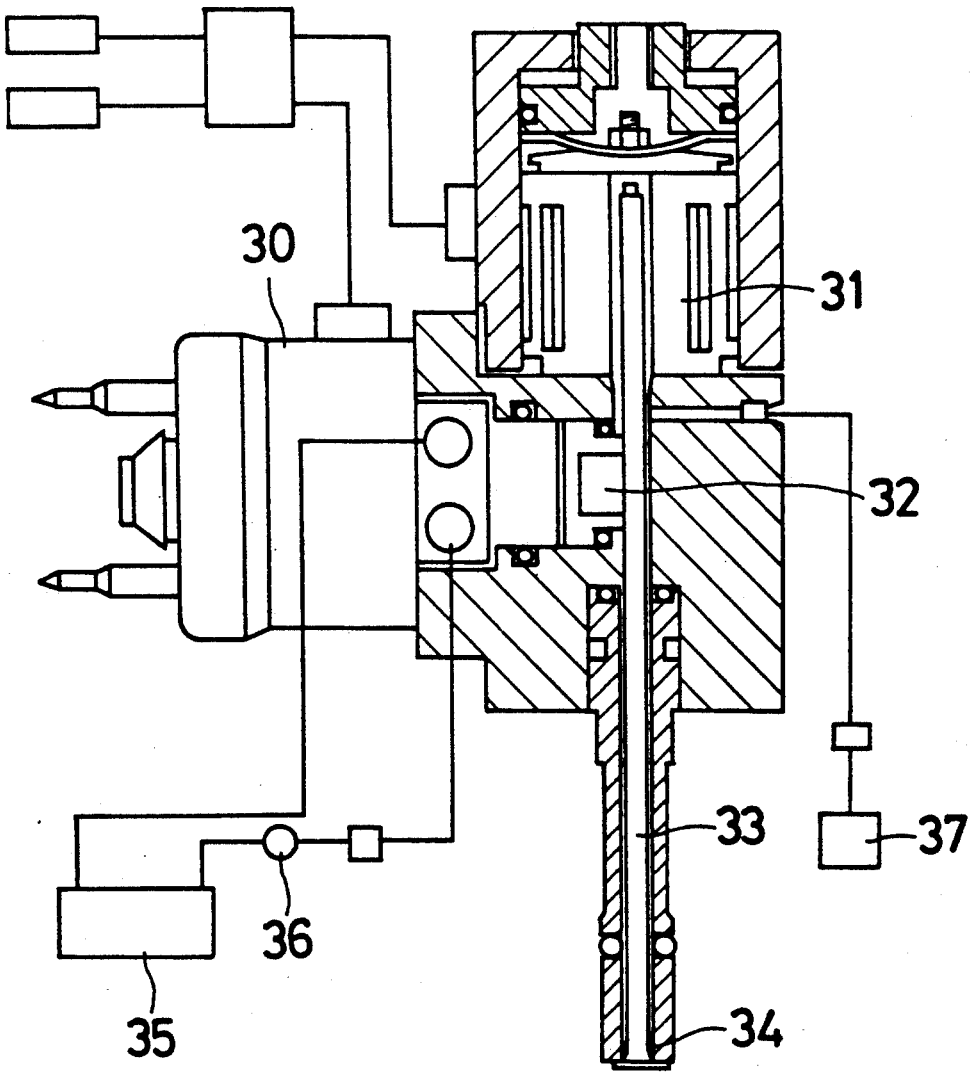
Fig. 3 (PRIOR ART)
FIG. 3 is a sectional view of a conventional fuel injection valve.

FIG. 2 shows the electric power supplied to the coil 14. First the lower current power is supplied to the coil 14 in a certain period of time (first stage) to supply the certain amount of fuel to the mixture passage 31 by opening the control valve 1. Then the higher current power is supplied to the coil 14 (second stage) to move the armature 6 to open the one way valve 12 of the injection nozzle port 16.

Although the invention has been described in connection with preferred embodiments thereof, it will be appreciated by those skill in the art additions, substitutions, modifications, and deletions not specifically described, may be without departing from the spirit and scope of the invention as defined in the appended claims.

What is claimed is:

1. A fuel injection valve comprising;

an armature made of magnetic material and having a hole, a coil placed around said armature, a fuel supply port connected to said hole of said armature, a first rod placed in said hole of said armature, a core made of magnetic material and having a hole, a control valve connected to said first rod and placed in said hole of said core, a nozzle connected to said core having an injection port, a second rod placed in said nozzle and having a fuel passage which is opened and closed by said control valve, a diaphragm attached to said second rod and dividing a room between said core and said nozzle into a fuel chamber and a mixture chamber, a first spring between said nozzle and said diaphragm to push said diaphragm toward said control valve, a second spring between said first rod and said armature to push said first rod toward the control valve, a mixture passage in said nozzle connecting said mixture chamber and said fuel passage, and a one way valve placed at said injection port of said nozzle, wherein when said control valve closes said fuel passage of said second rod, a gap is made between said control valve and said armature to establish a passage to supply fuel into said fuel chamber from said fuel supply port.

2. A fuel injection valve comprising;

a one way valve, a fuel chamber adjacent to said one way valve, a control valve for establishing/interrupting the fluid communication between said fuel chamber and said one way valve, and a single solenoid means for operating said one way valve and said control valve in such a manner that at a first stage said control valve is opened with said one way valve closed and at a second stage said one way valve is opened for injecting the fuel in said fuel chamber with said control valve closed.

3. A fuel valve in accordance with claim 2, wherein said one way valve is placed in series with said control valve.

* * * * *